US008689400B2

(12) United States Patent
Lee

(10) Patent No.: US 8,689,400 B2
(45) Date of Patent: Apr. 8, 2014

(54) VACUUM CLEANER

(75) Inventor: Byung-jo Lee, Gwuangju (KR)

(73) Assignee: Samsung Electronics Company, Ltd., Gwangsan-Gu (KR)

( * ) Notice: Subject to any disclaimer, the term of this patent is extended or adjusted under 35 U.S.C. 154(b) by 694 days.

(21) Appl. No.: 12/699,950

(22) Filed: Feb. 4, 2010

(65) Prior Publication Data

US 2010/0281647 A1 Nov. 11, 2010

(30) Foreign Application Priority Data

May 7, 2009 (KR) ..... 10-2009-0039676

(51) Int. Cl.
*A47L 9/10* (2006.01)

(52) U.S. Cl.
USPC ..... 15/353

(58) Field of Classification Search
USPC ..... 15/327.6, 347, 353, 412
See application file for complete search history.

(56) References Cited

U.S. PATENT DOCUMENTS

| | | | | |
|---|---|---|---|---|
| 5,840,103 | A * | 11/1998 | Dyson | 96/61 |
| 6,010,561 | A * | 1/2000 | Dyson | 96/63 |
| 6,289,553 | B1 * | 9/2001 | Dyson | 15/347 |
| 6,709,495 | B1 * | 3/2004 | Storer | 96/58 |
| 6,922,868 | B1 * | 8/2005 | Jeong | 15/353 |
| 8,161,599 | B2 * | 4/2012 | Griffith et al. | 15/353 |
| 2004/0074042 | A1 * | 4/2004 | Overvaag | 15/347 |
| 2006/0156508 | A1 * | 7/2006 | Khalil | 15/353 |

FOREIGN PATENT DOCUMENTS

| | | | |
|---|---|---|---|
| EP | 1 047 331 | B1 | 9/2002 |
| GB | 2460536 | | 12/2009 |
| KR | 1020040089208 | A | 4/2005 |
| KR | 1020050005863 | A | 7/2005 |
| KR | 1020070010283 | A | 1/2007 |

OTHER PUBLICATIONS

Search and Examination Report for corresponding United Kingdom Patent Application No. 1007212.2 dated Aug. 23, 2010.

* cited by examiner

*Primary Examiner* — Robyn Doan
*Assistant Examiner* — Brianne Kalach
(74) *Attorney, Agent, or Firm* — Ohlandt, Greeley, Ruggiero & Perle LLP

(57) ABSTRACT

A vacuum cleaner is provided that includes a main body, a dust-collecting unit mounted in the main body, a suction force generating unit mounted in the main body, a first filter unit disposed upstream from the suction force generating unit, and a second filter unit disposed downstream from the suction force generating unit, wherein the first filter unit and the second filter unit are disposed adjacent to each other, and are individually, detachably mounted in the main body.

18 Claims, 10 Drawing Sheets

VACUUM CLEANER

CROSS-REFERENCE TO RELATED APPLICATION

This application claims the benefit under 35 U.S.C. §119 (a) from Korean Patent Application No. 10-2009-0039676, filed on May 7, 2009, in the Korean Intellectual Property Office, the disclosure of which is incorporated herein by reference in its entirety.

BACKGROUND OF THE INVENTION

1. Field of the Invention

The present disclosure relates to a vacuum cleaner, and more particularly, to a vacuum cleaner that draws in air along with dust from a surface being cleaned using a vacuum pressure.

2. Description of the Related Art

In general, a vacuum cleaner draws in dust-laden air from a surface being cleaned, separates relatively large dust from the dust-laden air through a cyclone unit, and finally filters fine dust contained in air from which relatively large dust has been separated through a filter unit, so that cleaned air from which fine dust has been filtered is discharged outside a main body of the vacuum cleaner.

As disclosed in Korean Patent Laid-open No. 10-2007-0010283, and Korean Patent Registration Nos. 500848 and 485695, a conventional vacuum cleaner includes a drawer-type filter unit, which makes it easy to separate the filter unit from a cleaner main body.

This drawer-type filter unit of the conventional vacuum cleaner is disposed in a portion adjacent to a suction motor, that is, disposed upstream or downstream from the suction motor. However, since it is difficult to efficiently remove fine dust contained in air using only a single filter unit, a separate filter unit is further mounted in the vicinity of a discharge port of the cleaner main body. Accordingly, an additional space is required to house the separate filter unit in the vicinity of the discharge port of the cleaner main body, and thus the overall size of the cleaner main body may be increased.

Additionally, European Patent Application No. 1,047,331 discloses a conventional vacuum cleaner in which filter members are vertically disposed to enclose a cyclone unit. However, as the filter members are not in the form of drawers, it is difficult to attach or detach the filter members to or from the cyclone unit and it is also difficult to perform maintenance and repair work.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a vacuum cleaner that filters fine dust in two stages to increase a cleanliness of a discharged air, makes it easy to attach or detach a filter member for removing fine dust and that facilitates maintenance and repair.

The above aspects and/or other features of the present disclosure can substantially be achieved by providing a vacuum cleaner including a main body, a dust-collecting unit mounted in the main body, a suction force generating unit mounted in the main body, a first filter unit disposed upstream from the suction force generating unit, and a second filter unit disposed downstream from the suction force generating unit, wherein the first filter unit and the second filter unit are disposed adjacent to each other, and are individually, detachably mounted in the main body, and each of the first filter unit and the second filter unit includes a filter case, and a filter member detachably inserted into the filter case.

The filter case may be slidably withdrawn from the front of the main body.

The filter case may include a guide rail, and the main body may include a guide rail matching the guide rail of the filter case. In this situation, the guide rail of the filter case may protrude from the filter case along an outer circumference of the filter case.

One of the guide rail of the filter case and the guide rail of the main body may be formed in pairs, and the other guide rail may be formed as a single unit, so that the guide rails may be slidably engaged with each other.

At least one of the guide rail of the filter case and the guide rail of the main body may be engaged with a sealing member. In this situation, the sealing member may be attached to a leading edge of the guide rail. Additionally, a cross-section of the sealing member may be in the form of one of a circle, an oval and a polygon.

The guide rail of the filter case and the guide rail of the main body may be inclined in the same direction.

The first filter unit and the second filter unit may be separated from the main body in different directions.

The first filter unit may be disposed above the second filter unit, and the second filter unit may be disposed above the suction force generating unit.

As described above, according to the present disclosure, the first filter unit and the second filter unit may be configured in the form of drawers, and thus it is possible easily attach or detach the first filter unit and the second filter unit to or from the vacuum cleaner, and it is possible to facilitate maintenance and repair.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components, and structures.

DETAILED DESCRIPTION OF THE EXEMPLARY EMBODIMENTS

Hereinafter, a vacuum cleaner according to an exemplary embodiment of the present disclosure will be described with reference to the accompanying drawings.

Figure 1:
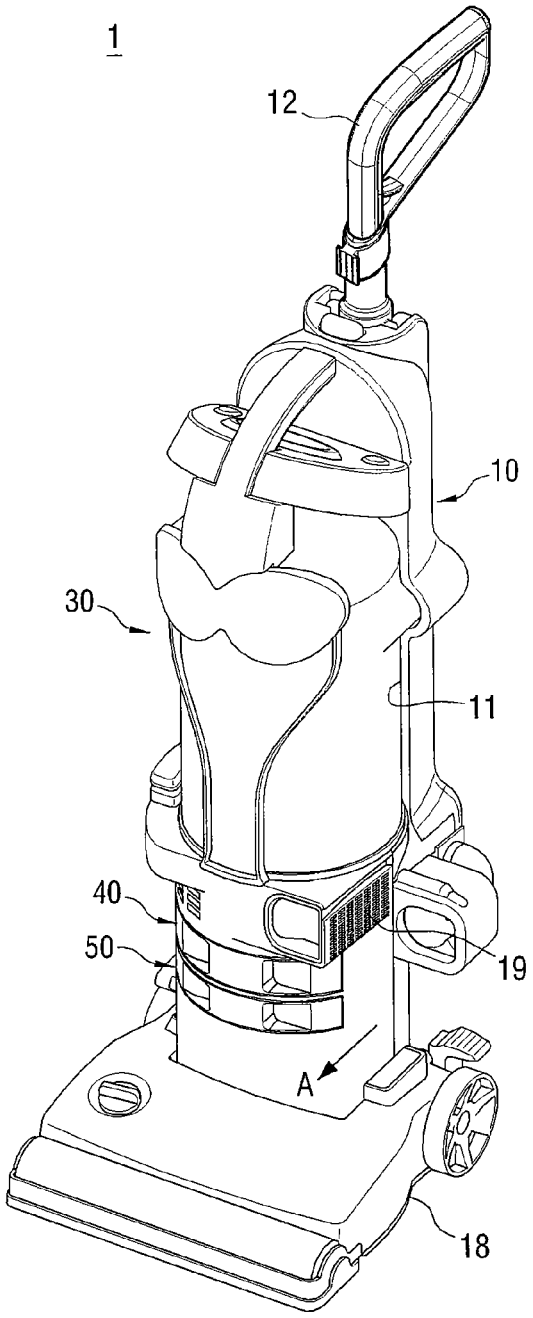
FIG. 1 is a schematic perspective view of a vacuum cleaner according to an exemplary embodiment of the present disclosure.

Referring to FIG. 1, a vacuum cleaner 1 according to an exemplary embodiment of the present disclosure includes a main body 10, a suction nozzle 18, a cyclone unit 30, a first filter unit 40, and a second filter unit 50.

The main body 10 is hingeably connected to the suction nozzle 18 mounted in a lower portion thereof, and a manipulation handle 12 mounted in an upper portion thereof. The suction nozzle 18 is fluidly communicable with the main body 10, to draw in dust-laden air from a surface being cleaned. The manipulation handle 12 enables a user to move the main body 10 on the surface being cleaned.

Figure 2:
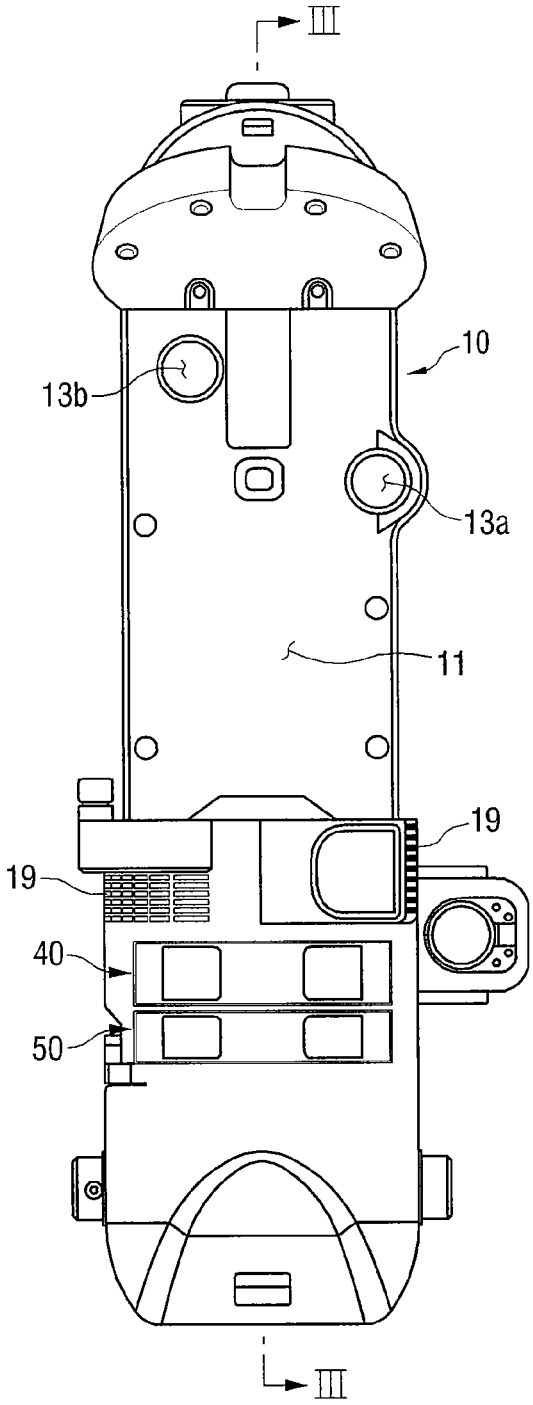
FIG. 2 is a front view of a main body of the vacuum cleaner of FIG. 1 from which a cyclone unit is detached.

Referring to FIG. 2, the main body 10 includes an accommodation unit 11 in which the cyclone unit 30 (FIG. 1) is detachably mounted in a front and upper portion thereof. The accommodation unit 11 includes a first discharge port 13*a* to guide dust-laden air drawn in through the suction nozzle 18 toward the cyclone unit 30, and a second inlet 13*b* to guide air from which dust has been separated by the cyclone unit 30 toward the inside of the main body 10.

Figure 3:
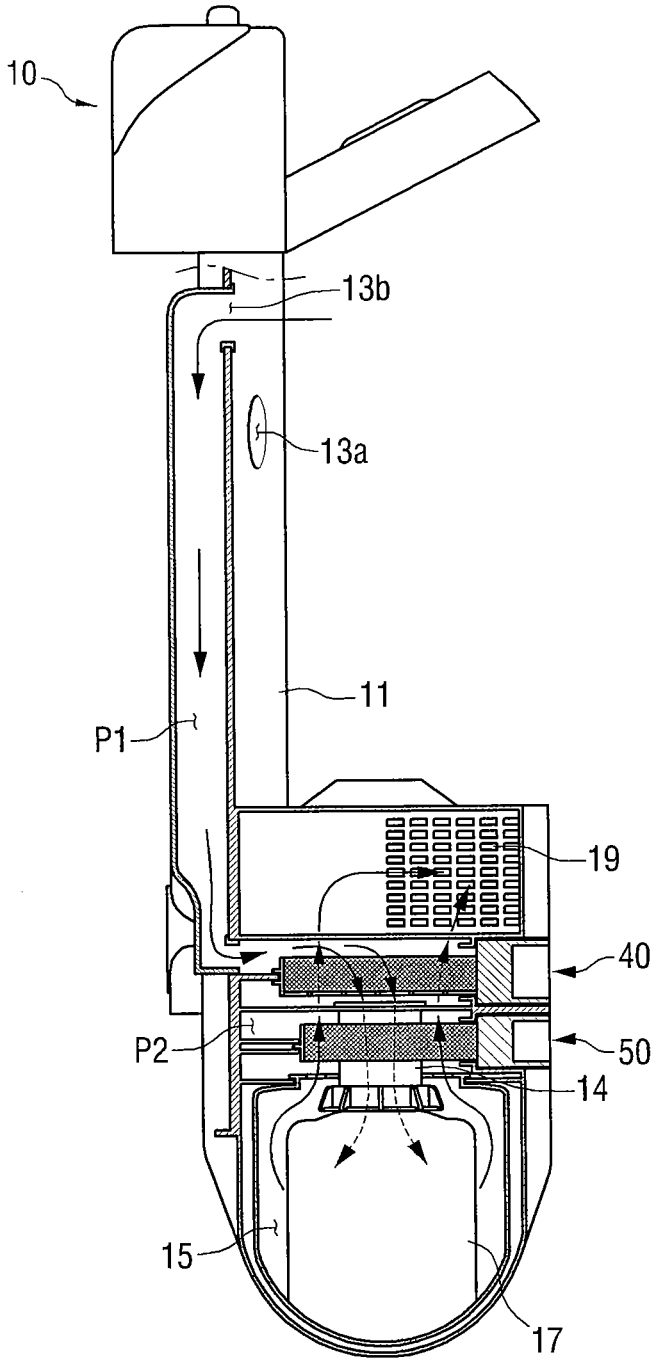
FIG. 3 is a cut-away view taken along line III-III shown in FIG. 2.

Referring to FIG. 3, the main body 10 includes a motor chamber 15 disposed below the accommodation unit 11. The motor chamber 15 includes a suction motor 17 as a suction force generating unit to generate a suction force. In this situation, the main body 10 further includes a discharge grill 19 through which air discharged through a plurality of pores 15*a* (see FIG. 4) from the motor chamber 15 is discharged to the outside of the main body 10.

Figure 4:
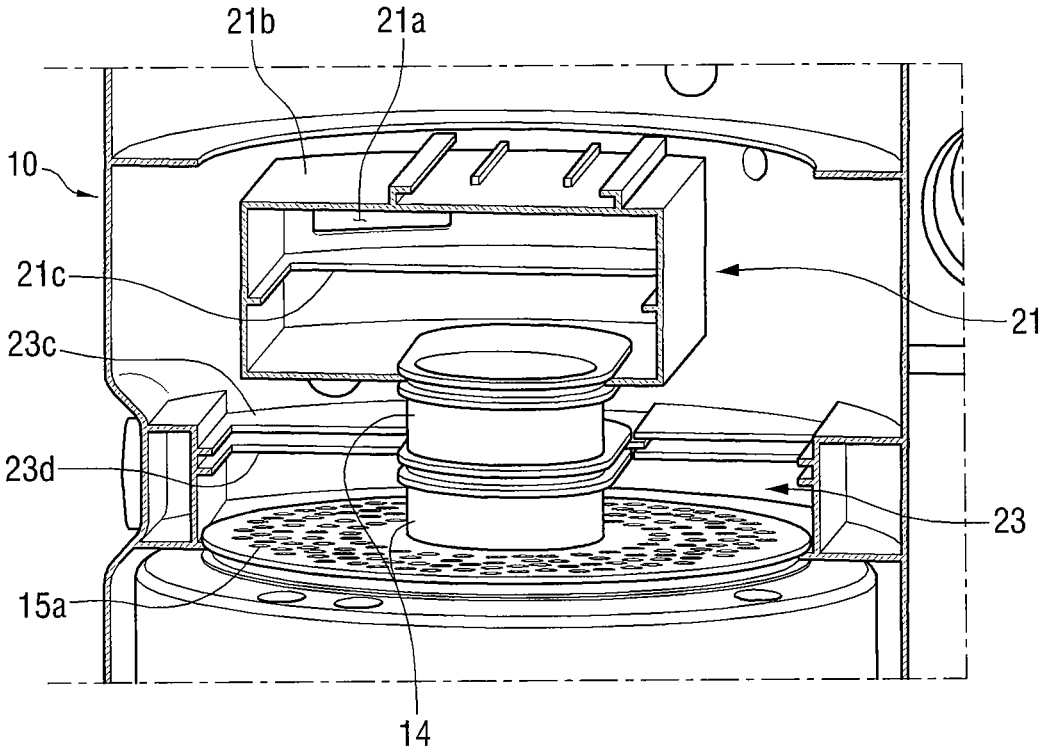
FIG. 4 is a partial schematic perspective view of a first filter mounting unit and a second filter mounting unit of the main body in which a first filter unit and a second filter unit are mounted, respectively.

Referring to FIG. 4, the main body 10 includes a first filter mounting unit 21 and a second filter mounting unit 23, which are disposed between the accommodation unit 11 and the motor chamber 15, and in which the first filter unit 40 and the second filter unit 50 are detachably mounted, respectively.

The first filter mounting unit 21 is disposed above the second filter mounting unit 23, and includes a third discharge port 21*a*. The third discharge port 21*a* fluidly communicates with a first flow path P1 (see FIG. 3) to guide air flowing in the main body 10 through the second inlet 13*b* toward the first filter mounting unit 21.

Additionally, the first filter mounting unit 21 includes a predetermined housing 21*b* that isolates the first filter mounting unit 21 from a second flow path P2 (see FIG. 3) extending from the plurality of pores 15*a* of the motor chamber 15 to the discharge grill 19. The housing 21*b* fluidly communicates with the motor chamber 15 through a connection pipe 14. The housing 21*b* includes a single second guide rail 21*c* extending substantially horizontally from an inner surface thereof.

The second filter mounting unit 23 is disposed above the motor chamber 15, and disposed in the second flow path P2 to fluidly communicate with the second flow path P2. The second filter mounting unit 23 includes a pair of fourth guide rails 23*c*, 23*d* extending substantially horizontally therefrom.

The first filter mounting unit 21 and the second filter mounting unit 23 are disposed so that the first filter unit 40 and the second filter unit 50 are withdrawn from the front of the main body 10 in the direction A, as shown in FIG. 1. However, the first filter mounting unit 21 and the second filter mounting unit 23 are not limited to such a configuration, and accordingly, the first filter unit 40 and the second filter unit 50 may be withdrawn from the main body 10 in different directions. For example, the first filter unit 40 may be withdrawn from the front of the main body 10, and the second filter unit 50 may be withdrawn from the rear or the side of the main body 10.

Additionally, the first filter mounting unit 21 and the second filter mounting unit 23 are disposed vertically adjacent to each other, and thus it is possible to make the main body 10 compact.

Figure 5:
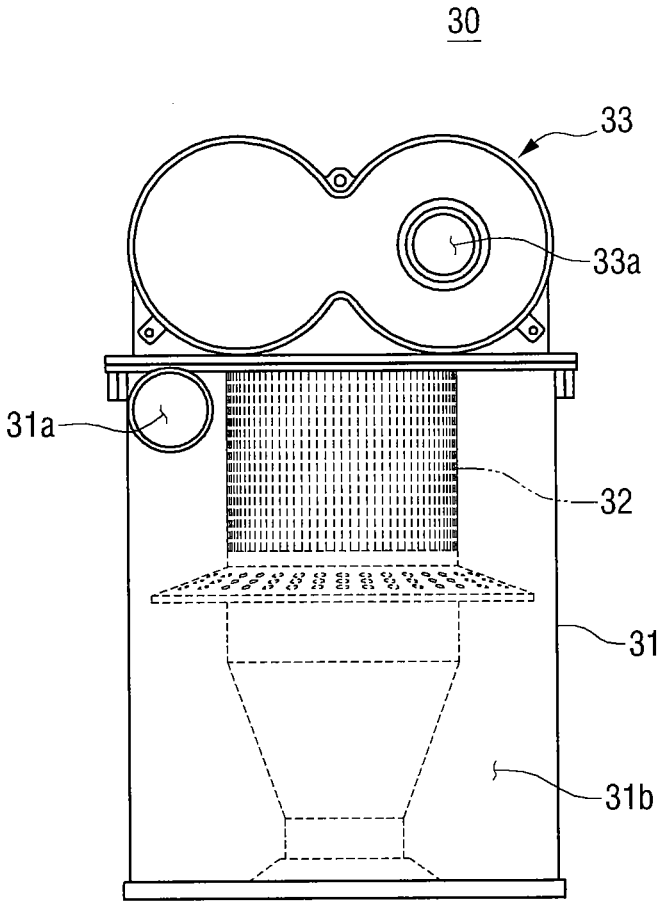
FIG. 5 is a rear view of the cyclone unit mounted in the main body.

Referring to FIG. 5, the cyclone unit 30 includes a first cyclone unit 31 and a second cyclone unit 33.

The first cyclone unit 31 includes a first inlet 31*a* formed in one side thereof to fluidly communicate with the first discharge port 13*a*. The first cyclone unit 31 includes a dust-collecting unit 31*b* to separate relatively large dust from air drawn in through the first inlet 31*a* and collect the separated dust, and a grill filter 32 disposed inside the central portion thereof.

The second cyclone unit 33 is disposed in parallel above the first cyclone unit 31, which is vertically disposed. The second cyclone unit 33 removes fine dust from air drawn in through the grill filter 32. Additionally, the second cyclone unit 33 includes a second discharge port 33*a* that fluidly communicates with the second inlet 13*b* of the main body 10 in order to discharge air from which fine dust has been removed by the second cyclone unit 33.

The cyclone unit 30 including both the first cyclone unit 31 and the second cyclone unit 33 has been described in the exemplary embodiment of the present disclosure, but there is no limitation thereto. Accordingly, the cyclone unit 30 may include only a single cyclone. In this situation, the cyclone unit 30 may desirably include an inlet (not shown) in fluid communication with the first discharge port 13*a* of the main body 10, and an outlet (not shown) in fluid communication with the second inlet 13*b*.

Figure 6:
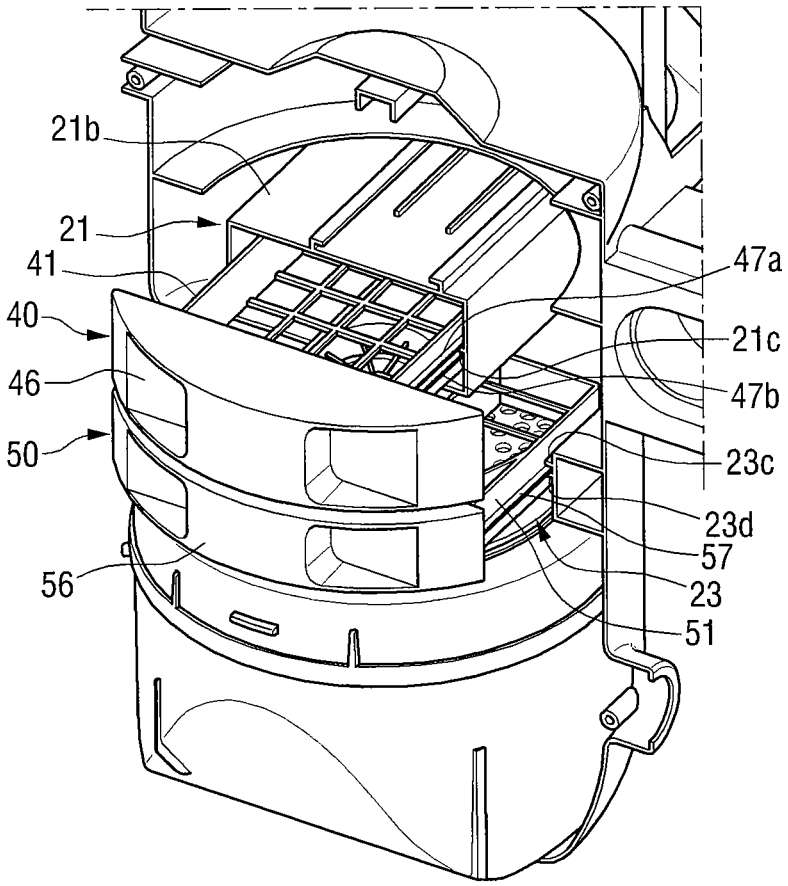
FIG. 6 is a partial schematic perspective view of the first filter unit and the second filter unit, which are mounted in the main body.

Referring to FIG. 6, the first filter unit 40 and the second filter unit 50 are mounted in the first filter mounting unit 21 and the second filter mounting unit 23, respectively, and may be withdrawn from the main body 10. In more detail, the first filter unit 40 is disposed upstream from the suction motor 17 (see FIG. 3) and the second filter unit 50 is disposed downstream from the suction motor 17, and accordingly it is possible to remove fine dust from air passing from the cyclone unit 30 in two stages.

Figure 7:
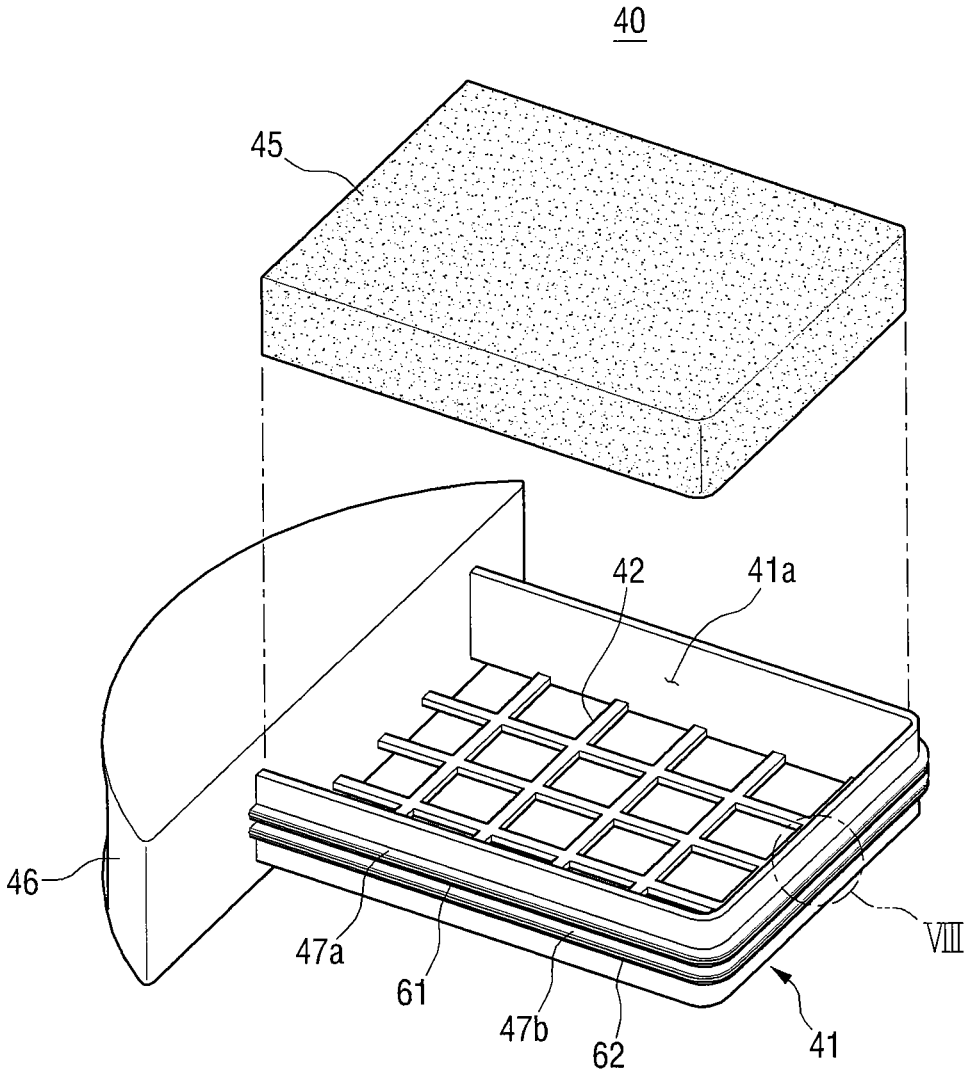
FIG. 7 is an exploded perspective view of the first filter unit.

Referring to FIG. 7, the first filter unit 40 includes a filter case 41 and a filter member 45. The filter case 41 includes a filter accommodation unit 41*a* into which the filter member 45 is detachably inserted, and a net-type support frame 42 in which the filter member 45 is seated.

Additionally, the filter case 41 includes a grip portion 46 whereby a user can easily withdraw the first filter unit 40 from the first filter mounting unit 21. The filter case 41 further includes a pair of first guide rails 47*a*, 47*b*, which are formed on portions other than the grip portion 46, along an outer circumference of the filter case 41. The pair of first guide rails 47*a*, 47*b* are slidingly engaged with the second guide rail 21*c* (see FIG. 6).

Figure 8:
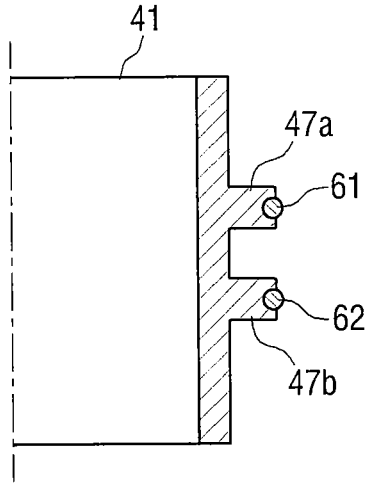
FIG. 8 is an enlarged sectional view of a portion VIII shown in FIG. 7.

Referring to FIG. 8, a pair of first sealing members 61, 62 are attached to leading edges of the pair of first guide rails 47*a*, 47*b*, respectively. If the first filter unit 40 is mounted in the first filter mounting unit 21, the pair of first sealing members 61, 62 may adhere closely to an inner wall of the housing 21*b* (see FIG. 4) of the first filter mounting unit 21, and may provide an airtight seal between the first filter mounting unit 21 and the first filter unit 40. Accordingly, it is possible to prevent pressure loss in the first flow path P1 (see FIG. 3), thereby preventing a reduction in the suction force of the vacuum cleaner.

Furthermore, the pair of first sealing members 61, 62 have circular cross-sections, but there is no limitation thereto. Accordingly, the pair of first sealing members 61, 62 may have oval cross-sections or polygonal cross-sections. Moreover, the second guide rail 21*c* may also be sealed with a predetermined sealing member on a leading edge thereof.

Figure 9:
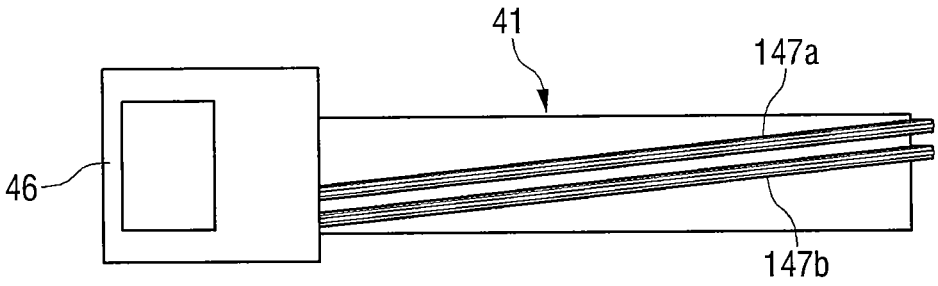
FIG. 9 is a side view of another embodiment of first guide rails formed in the first filter unit.

The pair of first guide rails 47*a*, 47*b* are aligned substantially parallel to the length of the filter case 41, but there is no limitation thereto. Accordingly, the filter case 41 may include a pair of first guide rails 147*a*, 147*b*, as shown in FIG. 9, which are inclined in a predetermined direction in order to reduce operation loads exerted on a wrist of a user when the user withdraws the first filter unit 40 from the main body 10. In this situation, the second guide rail 21*c* may also be inclined to match the pair of first guide rails 147*a*, 147*b*.

Additionally, the first guide rails 47*a*, 47*b*; 147*a*, 147*b* may be formed as a single unit, and the second guide rail 21*c* may be formed in pairs, unlike those described above.

Figure 10:
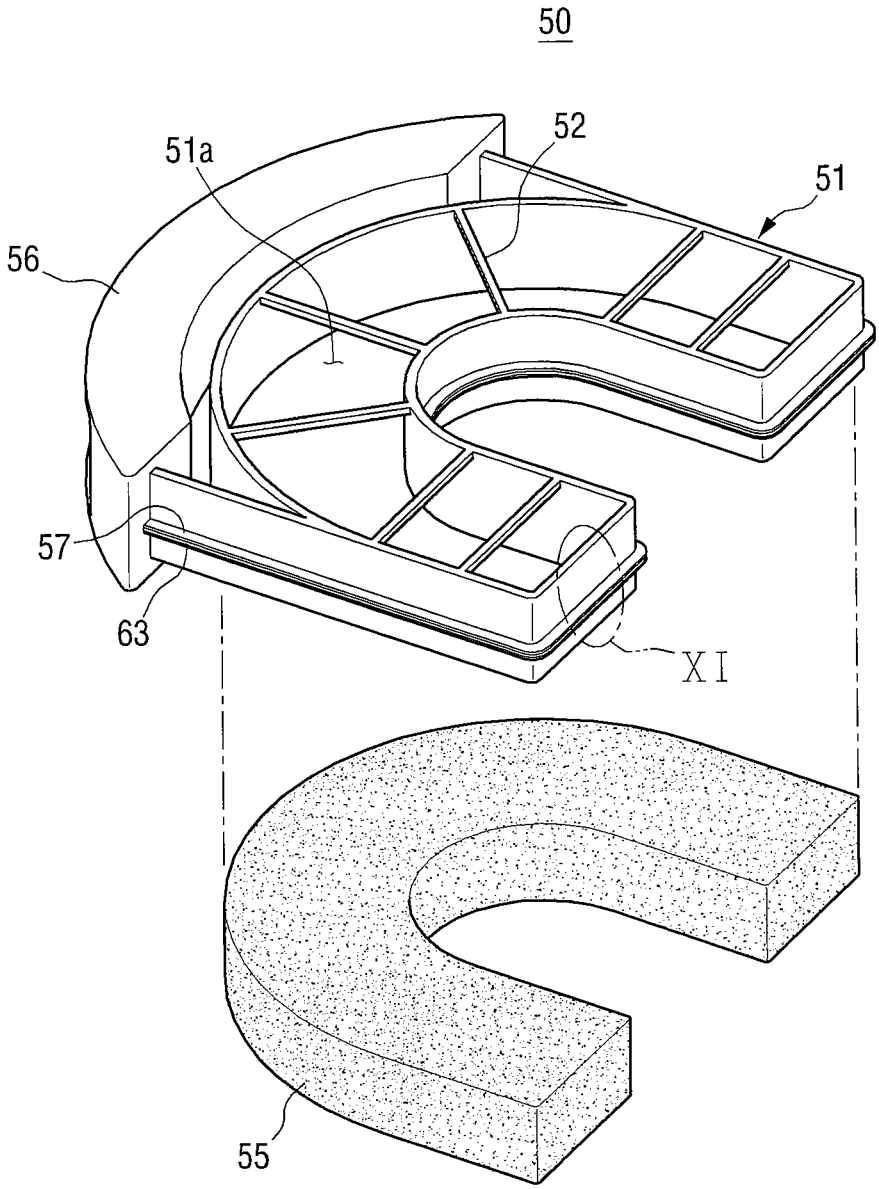
FIG. 10 is an exploded perspective view of the second filter unit.

Referring to FIG. 10, the second filter unit 50 includes a filter case 51 and a filter member 55, in the same manner as the first filter unit 40. The filter case 51 includes a filter accommodation unit 51*a* into which the filter member 55 is detachably inserted, and a net-type support frame 52 in which the filter member 55 is seated. Additionally, the filter case 51 is substantially in the form of "U" to enclose the connection pipe 14 (see FIG. 4). Accordingly, the filter member 55 may also be in the form of "U" corresponding to the shape of the filter case 51.

Additionally, the filter case 51 includes a grip portion 56 whereby a user can easily withdraw the second filter unit 50 from the second filter mounting unit 23. The filter case 51 further includes a third guide rail 57, which is formed on portions other than the grip portion 56, along an outer circumference of the filter case 51. The third guide rail 57 is slidingly engaged with the pair of fourth guide rails 23*c*, 23*d* (see FIG. 6) of the second filter mounting unit 23.

Figure 11:
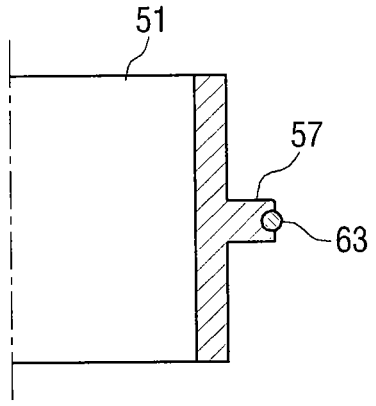
FIG. 11 is an enlarged sectional view of a portion XI shown in FIG. 10.

Referring to FIG. 11, a second sealing member 63 is attached to a leading edge of the third guide rail 57. If the second filter unit 50 is mounted in the second filter mounting unit 23, the second sealing member 63 may adhere closely to an inner wall of the second filter mounting unit 23, and may provide an airtight seal between the second filter mounting unit 23 and the second filter unit 50. Accordingly, it is possible to prevent pressure loss in the second flow path P2 (see FIG. 3), thereby preventing a reduction in the suction force of the vacuum cleaner.

Furthermore, the second sealing member 63 has a circular cross-section, but may have an oval cross-section or a polygonal cross-section, in the same manner as the pair of first sealing members 61, 62 attached to the pair of first guide rails 47*a*, 47*b*. Moreover, the pair of fourth guide rails 23*c*, 23*d* may also be sealed with predetermined sealing members on leading edges thereof, respectively.

In addition, the third guide rail 57 may be formed in pairs, and the pair of fourth guide rails 23*c*, 23*d* may be formed as a single unit, unlike those described above.

Hereinafter, the operation of the vacuum cleaner configured as described above is described now with reference to FIGS. 1, 3, and 5.

The vacuum cleaner 1 according to the present disclosure draws in dust-laden air from the surface being cleaned through the suction nozzle 18 so as to flow into the main body 10, during cleaning.

The dust-laden air drawn in the main body 10 is discharged from the main body 10 through the first discharge port 13*a*, and simultaneously flows into the first cyclone unit 31 through the first inlet 31*a* of the cyclone unit 30.

Relatively large dust is separated from the dust-laden air entering the first cyclone unit 31. Air from which the relatively large dust has been separated flows into the second cyclone unit 33 through the grill filter 32. Subsequently, relatively small dust is separated from the air by the second cyclone unit 33, and then air from which the relatively small dust has been separated is discharged through the second discharge port 33*a*.

Filtered air discharged from the cyclone unit 30 flows into the main body 10 through the second inlet 13*b* of the main body 10. Subsequently, the filtered air flows toward the first filter unit 40 through the first flow path P1 (see FIG. 3) and the third discharge port 21*a* (see FIG. 4) sequentially, and fine dust is then separated for a first time from the filtered air while the filtered air passing through the first filter unit 40.

Air discharged from the first filter unit 40 flows into the motor chamber 15 through the connection pipe 14, and then flows toward the second filter unit 50 through the motor chamber 15 along the second flow path P2. Subsequently, fine dust is separated for a second time from the air while the air passing through the second filter unit 50. Air from which the fine dust has been separated in two stages is then discharged to the outside of the main body 10 through the discharge grill 19.

The vacuum cleaner according to the exemplary embodiment of the present disclosure may include the first filter unit 40 and the second filter unit 50 in the form of drawers, and accordingly it is possible to easily attach or detach the first filter unit 40 and the second filter unit 50 to or from the main body 10, and it is also possible to facilitate maintenance and repair such as cleaning of the filter members 45 and 55.

Additionally, the first filter unit 40 and the second filter unit 50 are disposed upstream and downstream from the suction motor 17, respectively, and thus fine dust may be filtered in two stages. Therefore, it is possible to increase the cleanliness of air discharged to the outside of the main body 10.

Although representative exemplary embodiment of the present disclosure has been shown and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner comprising:

a main body;

a dust-collecting unit mounted in the main body;

a suction force generating unit mounted in the main body;

a first filter unit disposed upstream from the suction force generating unit and fluidly communicated with the suction force generating unit by a connection pipe; and a second filter unit disposed downstream from the suction force generating unit substantially in the form of a "U" to partially enclose the connection pipe, wherein the first filter unit and the second filter unit are disposed adjacent to each other, and are individually, slidably and detachably mounted from a front side of the main body, and wherein each of the first filter unit and the second filter unit comprises:

a filter case; and a filter member detachably inserted into the filter case.

2. The vacuum cleaner of claim 1, wherein the filter case comprises a guide rail, and the main body comprises a guide rail matching the guide rail of the filter case.

3. The vacuum cleaner of claim 2, wherein the guide rail of the filter case protrudes from the filter case along an outer circumference of the filter case.

4. The vacuum cleaner of claim 2, wherein one of the guide rail of the filter case and the guide rail of the main body is formed in pairs, and the other guide rail is formed as a single unit, so that the guide rails are slidably engaged with each other.

5. The vacuum cleaner of claim 2, wherein at least one of the guide rail of the filter case and the guide rail of the main body is engaged with a sealing member.

6. The vacuum cleaner of claim 5, wherein the sealing member is attached to a leading edge of the guide rail.

7. The vacuum cleaner of claim 5, wherein the sealing member has a cross-section selected from the group consisting of a circle, an oval, and a polygon.

8. The vacuum cleaner of claim 2, wherein the guide rail of the filter case and the guide rail of the main body are inclined in the same direction.

9. The vacuum cleaner of claim 1, wherein the first filter unit and the second filter unit are separated from the main body in different directions.

10. The vacuum cleaner of claim 1, wherein the first filter unit is disposed above the second filter unit, and the second filter unit is disposed above the suction force generating unit.

11. A vacuum cleaner comprising:

a main body;

a dust-collecting unit mounted in the main body;

a suction force generating unit mounted in the main body;

a first filter unit disposed in the main body upstream from the suction force generating unit and fluidly communicated with the suction force generating unit by a connection pipe; and a second filter unit disposed in the main body downstream from the suction force generating unit substantially in the form of a "U" to partially enclose the connection pipe, wherein the second filter unit is above the suction force generating unit and the first filter unit is above the second filter unit, and wherein the first filter unit and the second filter unit are disposed adjacent to each other and are individually, slidably and detachably mounted from a front side of the main body.

12. The vacuum cleaner of claim 11, wherein the first filter unit and the second filter unit are separated from the main body in different directions.

13. The vacuum cleaner of claim 11, wherein the first filter unit and the second filter unit are separated from the main body in a common direction.

14. The vacuum cleaner of claim 11, wherein the first filter unit comprises:

a first filter case; and a first filter member detachably inserted into the first filter case.

15. The vacuum cleaner of claim 11, wherein the second filter unit comprises:

a second filter case; and a second filter member detachably inserted into the second filter case, the second filter case being slidably withdrawn from a front of the main body.

16. A vacuum cleaner comprising:

a main body having a first filter mounting unit and a second filter mounting unit, the first and second filter mounting units being adjacent to each other;

a dust-collecting unit mounted in the main body;

a suction force generating unit mounted in the main body;

a first filter case slidably disposed in the first filter mounting unit upstream from the suction force generating unit and fluidly communicated with the suction force generating unit by a connection pipe; and a second filter case slidably disposed in the second filter mounting unit downstream from the suction force generating unit substantially in the form of a "U" to partially enclose the connection pipe, wherein the first and second filter cases are individually, slidably withdrawn from a front side of the main body.

17. The vacuum cleaner of claim 16, further comprising first filter member removably mounted in the first filter case and a second filter member removably mounted in the second filter case.

18. The vacuum cleaner of claim 16, wherein the first filter case and the second filter case are slidably withdrawn from the main body in a common direction.

* * * * *